US008573314B2

(12) United States Patent
Corre et al.

(10) Patent No.: US 8,573,314 B2
(45) Date of Patent: Nov. 5, 2013

(54) PACKER SYSTEM WITH REDUCED FRICTION DURING ACTUATION

(75) Inventors: Pierre-Yves Corre, Eu (FR); Jean-Louis Pessin, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 84 days.

(21) Appl. No.: 12/274,811

(22) Filed: Nov. 20, 2008

(65) Prior Publication Data

US 2010/0122821 A1 May 20, 2010

(51) Int. Cl.
*E21B 33/12* (2006.01)

(52) U.S. Cl.
USPC ..... 166/387; 166/187

(58) Field of Classification Search
USPC ..... 166/187, 387; 277/323, 328, 331, 337
See application file for complete search history.

(56) References Cited

U.S. PATENT DOCUMENTS

| | | | | | |
|---|---|---|---|---|---|
| 2,723,721 | A * | 11/1955 | Corsette | ..... | 277/341 |
| 2,778,432 | A * | 1/1957 | Allen | ..... | 277/334 |
| 3,905,399 | A * | 9/1975 | Dunnet | ..... | 138/129 |
| 4,349,204 | A * | 9/1982 | Malone | ..... | 277/334 |
| 4,614,346 | A * | 9/1986 | Ito | ..... | 277/334 |
| 4,923,007 | A * | 5/1990 | Sanford et al. | ..... | 277/334 |
| 5,183,108 | A * | 2/1993 | Lee et al. | ..... | 277/334 |
| 5,205,567 | A * | 4/1993 | Quinlan et al. | ..... | 277/334 |
| 5,280,824 | A * | 1/1994 | Eslinger et al. | ..... | 166/187 |
| 5,361,479 | A | 11/1994 | Sorem | | |
| 5,361,836 | A * | 11/1994 | Sorem et al. | ..... | 166/187 |
| 5,363,542 | A | 11/1994 | Sorem et al. | | |
| 5,439,053 | A | 8/1995 | Eslinger et al. | | |
| 5,613,555 | A | 3/1997 | Sorem et al. | | |
| 5,702,109 | A * | 12/1997 | Mahin et al. | ..... | 277/340 |
| 5,778,982 | A * | 7/1998 | Hauck et al. | ..... | 166/387 |
| 7,331,581 | B2 | 2/2008 | Xu et al. | | |
| 7,363,970 | B2 | 4/2008 | Corre et al. | | |
| 7,510,015 | B2 * | 3/2009 | Corre et al. | ..... | 166/387 |
| 2003/0037932 | A1 * | 2/2003 | Guillory et al. | ..... | 166/387 |
| 2004/0216871 | A1 * | 11/2004 | Mendez et al. | ..... | 166/187 |
| 2005/0109502 | A1 * | 5/2005 | Buc Slay et al. | ..... | 166/179 |
| 2007/0144734 | A1 * | 6/2007 | Xu et al. | ..... | 166/187 |
| 2007/0193736 | A1 * | 8/2007 | Corre et al. | ..... | 166/187 |
| 2010/0051259 | A1 * | 3/2010 | Pessin et al. | ..... | 166/120 |
| 2010/0071911 | A1 * | 3/2010 | Carree | ..... | 166/386 |
| 2010/0288511 | A1 * | 11/2010 | Corre et al. | ..... | 166/387 |

* cited by examiner

*Primary Examiner* — Shane Bomar
*Assistant Examiner* — Catherine Loikith
(74) *Attorney, Agent, or Firm* — John Vereb

(57) ABSTRACT

A technique involves a packer formed as an expandable packer with an internal expandable bladder. A mechanical structure is deployed around the expandable bladder, and an anti-extrusion layer is located between the internal, expandable bladder and the mechanical structure. A separate protective layer is positioned between the internal, expandable bladder and the mechanical structure to reduce friction.

12 Claims, 2 Drawing Sheets

PACKER SYSTEM WITH REDUCED FRICTION DURING ACTUATION

BACKGROUND

A variety of packers are used in wellbores to isolate specific wellbore regions. A packer is delivered downhole on a tubing string and a packer sealing element is expanded against the surrounding wellbore wall to isolate a region of the wellbore. Often, two or more packers can be used to isolate several regions in a variety of well related applications, including production applications, service applications and testing applications.

In some well applications, inflatable packers are used to isolate specific regions of wellbores. Inflatable packers generally comprise an inflatable inner bladder to seal the inflation pressure. A mechanical structure is arranged around the inner bladder to provide resistance to inflation pressure and to secure the packer against pressure differentials between regions of the wellbore when the packer is inflated. An outer cover can be placed around the mechanical structure to ensure a seal is formed with respect to the differential pressures. Sometimes, an additional layer is placed between the mechanical structure and the inner bladder to prevent extrusion of the inner bladder. However, substantial friction exists along the additional layer which can prematurely damage packer components, such as the inflatable inner bladder.

SUMMARY

In general, the present invention provides a system and method for use in a wellbore to isolate specific regions in a wellbore. The system and methodology utilize a packer formed with an internal bladder, a mechanical structure, and an anti-extrusion layer between the internal bladder and the mechanical structure. Additionally, a separate protective layer is positioned between the internal bladder and the mechanical structure to reduce friction along the anti-extrusion layer.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method that facilitate the use of expandable packers in wellbore environments. The system and methodology enable the expansion and contraction of expandable packers while reducing wear that otherwise can occur as a result of friction between moving components. By reducing wear and the potential for damage, the packer can be used more reliably to form seals within a wellbore. In one example, a protection layer is formed of an anti-friction material and deployed between layers of the packer to facilitate expansion and contraction of the packer. One or more protection layers can be formed of an expandable, anti-friction material and disposed between, for example, a packer anti-expansion layer and one or more adjacent layers.

In one embodiment, an expandable packer is formed with an internal, expandable bladder. A mechanical layer/structure is located around the internal, expandable bladder, and an anti-extrusion layer is positioned between the internal, expandable bladder and the mechanical layer. A separate, protection layer also is disposed between the internal, expandable bladder and the mechanical layer to protect one or more of the packer components from wear during expansion and/or contraction of the packer.

Figure 1:
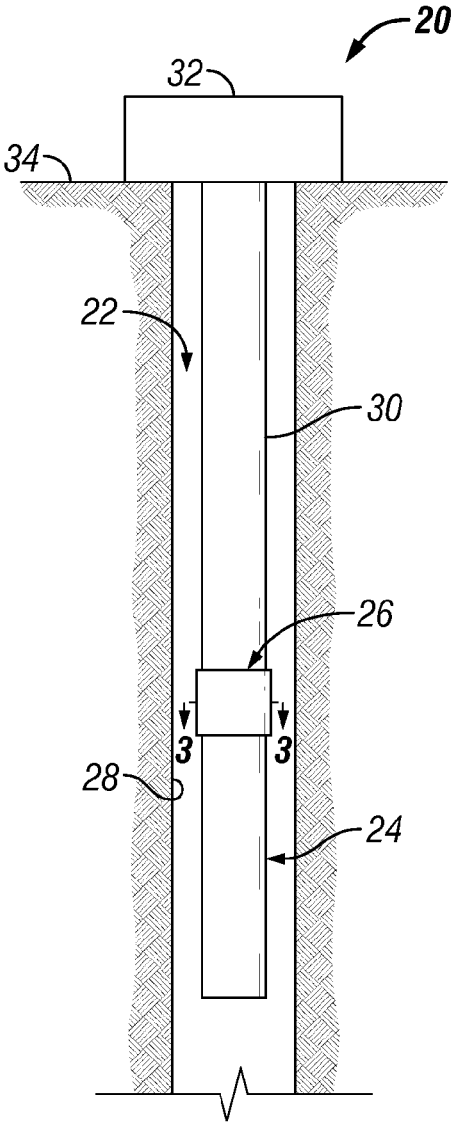
FIG. 1 is a schematic front elevation view of a well system having a packer deployed in a wellbore, according to an embodiment of the present invention.

Referring generally to FIG. 1, an example of a well system 20 is illustrated as deployed in a wellbore 22, according to embodiment of the present invention. The well system 20 comprises a well tool 24, e.g. a well tool string, and at least one packer 26 mounted for cooperation with the well tool 24. In this embodiment, packer 26 comprises an expandable packer, such as an inflatable packer. In FIG. 1, packer 26 is in a radially contracted configuration to enable movement along wellbore 22 within, for example, a tubular structure 28. By way of example, tubular structure 28 may comprise a well casing or other well tubing. The packer 26 is deployed and retrieved via a conveyance 30 extending downwardly from, for example, a wellhead 32 located at a surface location 34, such as a subsea surface or a surface of the earth. The conveyance 30 may comprise coiled tubing, production tubing, wireline, slickline, or other suitable conveyances.

Figure 2:
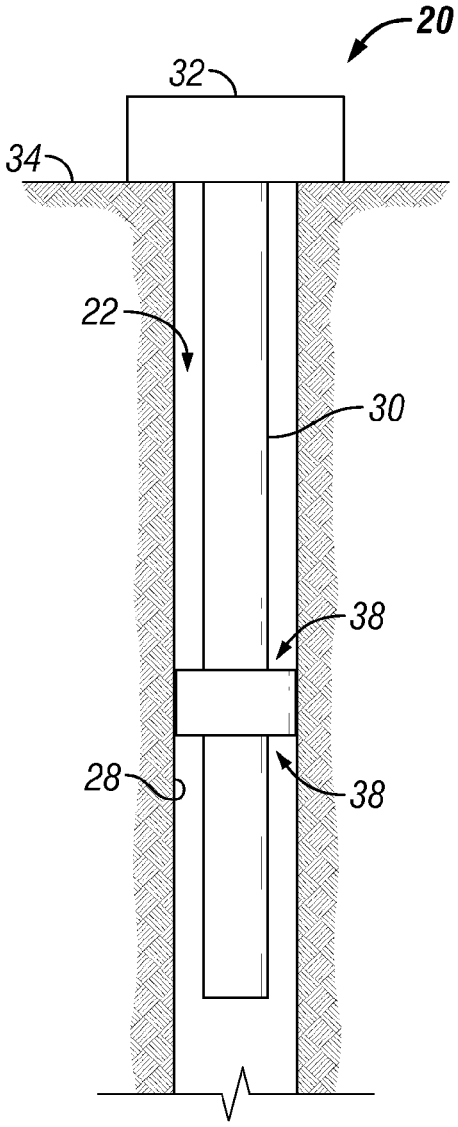
FIG. 2 is a schematic illustration similar to that of FIG. 1 but showing the packer in an expanded configuration, according to an embodiment of the present invention.

As illustrated in FIG. 2, packer 26 can be selectively expanded in a radially outward direction to form a seal with a surrounding wellbore wall/surface 38, such as an inside surface of tubular structure 28. Expansion of packer 26 to the sealing configuration isolates regions 38 along wellbore 22. Depending on the application, a plurality of packers 26 can be combined with well tool 24 to create additional isolated regions 38 along wellbore 22. In some applications, packer 26 can be repeatedly expanded and contracted between the configurations illustrated in FIGS. 1 and 2.

Figure 3:
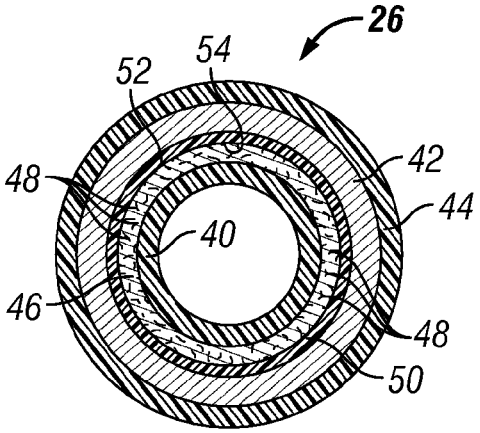
FIG. 3 is a schematic cross-sectional view of one example of the packer, according to an embodiment of the present invention.

Referring generally to FIG. 3, one embodiment of packer 26 is schematically illustrated in a cross-sectional view taken generally along line 3-3 of FIG. 1. In this embodiment, packer 26 comprises an internal, expandable bladder 40 and a mechanical layer or structure 42 surrounding the expandable bladder 40. By way of example, internal expandable bladder 40 may be formed from an elastomeric material, such as rubber, which allows the expandable bladder 40 to be repeatedly expanded and contracted in a radial direction by inflation and deflation or by another suitable type of actuation. In the example illustrated, packer 26 further comprises an outer seal layer 44 disposed around mechanical layer 42 to facilitate sealing engagement with a surrounding surface, such as the inside surface of tubular structure 28. The outer seal layer 44 also may be formed from an elastomeric material, such as a rubber material.

In the embodiment illustrated, packer 26 also comprises an anti-extrusion layer 46 disposed between internal, expandable bladder 40 and mechanical layer 42. The anti-extrusion layer 46 may be formed from a variety of materials designed to prevent extrusion of expandable bladder 40 through mechanical layer 42 under the pressures and forces of expansion. By way of example, anti-extrusion layer 46 may comprise a composite material having multiple, internal reinforcement structures 48. The reinforcement structures 48 may comprise small cables having a diameter less than, for example, approximately 0.5 mm. In other embodiments, the reinforcement structures 48 may comprise fibers, such as carbon fibers. In one specific example, the reinforcement structures 48 comprise carbon fibers set at an angle of between approximately 2° and 20° relative to an axis of the packer 26. Furthermore, the fibers may be lubricated with an appropriate lubricant within anti-extrusion layer 46. For example, the fibers can be lubricated with grease or with dry lubricant placed along the outside diameter of the fibers by extrusion or other suitable processes. The dry lubricant may comprise a thermoplastic material or a low friction elastomer. In other embodiments, the reinforcement structures 48 may comprise other features, such as blades formed of a metallic material or other suitable materials.

In the embodiment illustrated in FIG. 3, packer 26 further comprises a protection layer 50 formed of an anti-friction material disposed between internal, expandable bladder 40 and mechanical layer 42. By way of example, protection layer 50 may be formed from a solid material deployed between packer components to reduce friction and thus reduce wear on the packer components. The protection layer 50 can be formed as a protective sheet disposed within or wrapped around specific components of the packer.

In one example, the protection layer 50 is formed from an elastic material that can freely expand and contract with the expansion and contraction of packer 26 while retaining its low friction coefficient to facilitate sliding movement of adjacent packer components. The protection layer 50 can be formed with silicon, rubber or other elastomeric materials that resist tearing or other degradation while retaining their low friction characteristics. In other applications, the protection layer 50 can be formed from a high expansion thermoplastic, such as crude polytetrafluoroethylene (PTFE). With any of these materials, protection layer 50 can be formed as a solid sheet that may be deployed between desired components of packer 26 for expansion and contraction with packer 26.

As illustrated, the protection layer 50 can be disposed adjacent anti-extrusion layer 46 to reduce both friction and wear between the anti-extrusion layer 46 and adjacent layers of the packer. The protection layer 50 can be disposed along a radially outward surface 52 of anti-extrusion layer 46 to provide anti-friction material between mechanical layer 42 and anti-extrusion layer 46. In other embodiments, the protection layer 50 can be disposed along a radially inward surface 54 of anti-extrusion layer 46 to provide anti-friction material between expandable bladder 40 and anti-extrusion layer 46. A plurality of protection layers 50 also can be used and deployed along both radially outward surface 52 and radially inward surface 54, or a long other components of packer 26.

Figure 4:
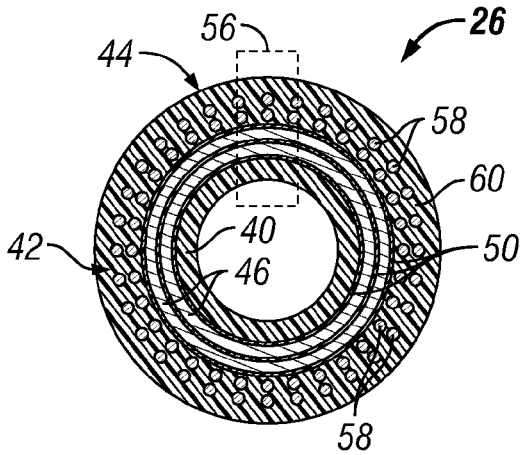
FIG. 4 is a cross-sectional view of another example of the packer, according to an alternate embodiment of the present invention.
Figure 5:
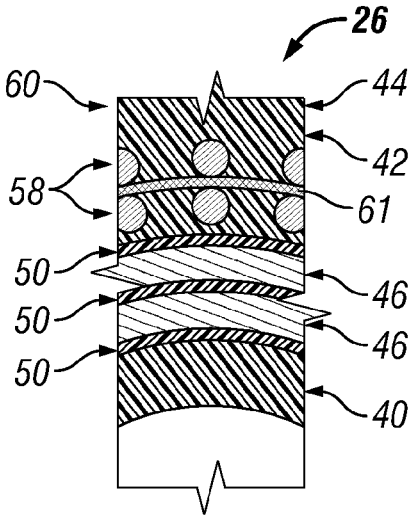
FIG. 5 is a view of an enlarged portion of the packer illustrated in FIG. 4, according to an embodiment of the present invention.

Referring generally to FIG. 4, another embodiment of packer 26 is illustrated. In this embodiment, a plurality of anti-extrusion layers 46 and a plurality of protection layers 50 are disposed between inner, expandable bladder 40 and mechanical layer 42. By way of example, the anti-extrusion layers 46 and the protection layers 50 may be arranged in an alternating configuration along a radial direction. A portion of the view illustrated in FIG. 4 is highlighted by an outlined box 56 and enlarged in FIG. 5.

In the example illustrated, mechanical layer 42 comprises a plurality of cables 58 routed through an expandable medium 60, such as an elastomeric medium which may comprise rubber or other suitable materials. The cables 58 may be formed out of metal or other suitable materials to provide substantial strength to mechanical layer 42. In some embodiments, the cables 58 may be arranged in a manner that enables expansion of packer 26 without the use of expandable medium 60. In addition, a protective layer, made of a plurality of fibers, such as KEVLAR fibers or carbon fibers 61 may be inserted between adjacent cable layers 58.

As further illustrated, the radially outward protection layer 50 is positioned between the mechanical layer 42 and one of the anti-extrusion layers 46 to prevent, for example, the anti-extrusion layer from being damaged by cables 58. Another protection layer 50 is positioned between anti-extrusion layers 46 to prevent the anti-extrusion layers from damaging each other. A radially inward protection layer 50 is disposed between inner, expandable bladder 40 and the radially inward anti-extrusion layer 46 to prevent, for example, wear/damage to expandable bladder 40 by the anti-extrusion layer 46. The protection layers 50 comprise an anti-friction material that may be formed as solid sheets located between components to reduce friction and to reduce or eliminate wear between the adjacent components.

It should be noted that the number of anti-extrusion layers 46 is not limited to one or two layers and may comprise a higher number of layers. Similarly, the number of protection layers 50 can vary depending on the design of packer 26. For example, an individual protection layer can be used or a plurality of protection layers, e.g. 2, 3 or more protection layers, can be deployed to reduce friction between packer components.

Figure 6:
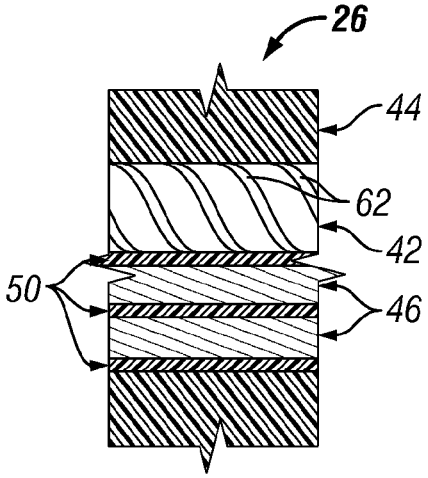
FIG. 6 is a view similar to that of FIG. 5 but showing an alternate example of the packer, according to an alternate embodiment of the present invention.

Referring generally to FIG. 6, another embodiment of packer 26 is illustrated. In this embodiment, an alternate mechanical layer/structure 42 is illustrated in which a plurality of packer slats 62 is arranged to create a slat packer. The packer slats 62 are positioned to slide past each other as packer 26 is expanded. Ultimately, the packer slats 62 are pressed together as the packer is sealed against the surrounding surface, e.g. the inside surface of tubular structure 28. In some applications, the outer seal layer 44 is disposed around the layer of packer slats 62 to facilitate sealing engagement with the surrounding surface. In the embodiment illustrated, the anti-extrusion layers 46 and protection layers 50 are arranged in an alternating configuration. However, other arrangements of protection layers 50 and anti-extrusion layers 46 can be incorporated into the packer design. Additionally, a single protection layer 50 and/or a single anti-extrusion layer 46 can be employed between expandable bladder 40 and mechanical layer 42 in some applications.

The overall well system 20 can be constructed in a variety of configurations for use in many environments and applications. For example, one or more packers 26 can be combined with a variety of well tools 24 to facilitate well testing operations, well treatment operations, well production operations, and other well related operations. Additionally, the packer 26 can be constructed from several types of materials and components. The mechanical layer can be formed from a variety of mechanical structures and may comprise individual materials or composite materials. Similarly, the anti-extrusion layers can be made from a variety of materials and can be reinforced via several types of reinforcement structures. Additionally, if more than one anti-extrusion layer is used, the layers can be formed from different materials or different arrangements of materials relative to each other. The protection layer also can be formed from several types of materials or mixtures of materials. If more than one protection layer is used in a given packer, the material or design of individual protection layers can be different from other protection layers. Furthermore, the expandable bladder can be created from various elastomeric materials, composite materials, and other materials that can accommodate expansion and contraction of the packer. Packer 26 also can be constructed in several configurations with a variety of additional components/structures integrated into the packer design.

In any of the embodiments described above where a component is described as being formed of rubber or comprising rubber, the rubber may include an oil resistant rubber, such as NBR (Nitrile Butadiene Rubber), HNBR (Hydrogenated Nitrile Butadiene Rubber) and/or FKM (Fluoroelastomers). In a specific example, the rubber may be a high percentage acrylonytrile HNBR rubber, such as an HNBR rubber having a percentage of acrylonytrile in the range of approximately 21 to approximately 49%.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A packer structure comprising:

an inner bladder expandable in a radial direction by inflation;

a mechanical layer at least partially surrounding the inner bladder;

an anti-extrusion layer positioned between the mechanical layer and the inner bladder, the anti-extrusion layer having a reinforcement structure to prevent extrusion of the inner bladder through mechanical layer;

a protection layer positioned between the anti-extrusion layer and the mechanical layer, the protection layer expandable with the inner bladder while minimizing friction between the anti-extrusion layer and the mechanical layer and improving sliding movement of the anti-extrusion layer with respect to the mechanical layer.

2. The system as recited in claim 1, wherein the protection layer is disposed adjacent a radially outward surface of the anti-extrusion layer.

3. The system as recited in claim 1, wherein the protection layer is disposed adjacent a radially inward surface of the anti-extrusion layer.

4. The system as recited in claim 1, wherein the mechanical layer comprises a plurality of cables.

5. The system as recited in claim 1 wherein the reinforcement structure comprises a plurality of cables or fibers with a lubricant.

6. The system as recited in claim 1 wherein the reinforcement structure comprises cables or fibers positioned at an angle less than 90 degrees with respect to the axis of the packer structure.

7. The system as recited in claim 1, wherein the protection layer is formed of a thermoplastic.

8. The system of claim 1 wherein the protection layer comprises a plurality of layers.

9. The system as recited in claim 8, wherein the plurality of protection layers comprises at least one protection layer disposed adjacent a radially outward surface of the anti-extrusion layer and at least one protection layer disposed adjacent a radially inward surface of the anti-extrusion layer.

10. A system, comprising:

an inflatable bladder;

a mechanical layer surrounding the inflatable bladder;

an anti-extrusion layer positioned between the inflatable bladder and the mechanical layer; and a protective sheet formed of an expandable material and deployed between the inflatable bladder and the mechanical layer to reduce friction with the anti-extrusion layer below a friction that would exist without the protective sheet and increase sliding movement of the mechanical layer with respect to the anti-extrusion layer which occurs without the protective sheet.

11. The system as recited in claim 10, wherein the protective sheet is formed from an elastomeric material.

12. The system as recited in claim 10, wherein the anti-extrusion layer comprises a plurality of anti-extrusion layers, and the protective sheet comprises a plurality of protective sheets.

* * * * *